US008820956B2

(12) United States Patent
Reznik et al.

(10) Patent No.: US 8,820,956 B2
(45) Date of Patent: Sep. 2, 2014

(54) LIGHTED PICK TOOL

(75) Inventors: Brian Reznik, Carmel, NY (US); Qiu Jianping, Hangzhou (CN)

(73) Assignee: Ullman Devices Corporation, Ridgefield, CT (US)

( * ) Notice: Subject to any disclaimer, the term of this patent is extended or adjusted under 35 U.S.C. 154(b) by 15 days.

(21) Appl. No.: 13/286,547

(22) Filed: Nov. 1, 2011

(65) Prior Publication Data

US 2012/0327636 A1 Dec. 27, 2012

Related U.S. Application Data

(60) Provisional application No. 61/500,688, filed on Jun. 24, 2011.

(51) Int. Cl.
*B25B 23/18* (2006.01)

(52) U.S. Cl.
USPC ..... 362/120; 362/109

(58) Field of Classification Search
USPC ..... 362/109, 119, 120; 294/26; 81/489
See application file for complete search history.

(56) References Cited

U.S. PATENT DOCUMENTS

| | | | | |
|---|---|---|---|---|
| 6,325,522 | B1 * | 12/2001 | Walian | 362/119 |
| 6,336,731 | B1 * | 1/2002 | Chien | 362/120 |
| 6,890,083 | B2 * | 5/2005 | Cochran | 362/119 |
| 2002/0154499 | A1 * | 10/2002 | Hsieh | 362/120 |
| 2008/0144309 | A1 * | 6/2008 | Nagata et al. | 362/120 |
| 2011/0289780 | A1 * | 12/2011 | Tiegs | 30/123 |

* cited by examiner

*Primary Examiner* — Peggy Neils
(74) *Attorney, Agent, or Firm* — Bachman & LaPointe, P.C.

(57) ABSTRACT

The present invention relates to a lighted pick tool. The lighted pick tool includes a lighted pick tool, comprising a handle; a pick tool extending from the handle; and a light mounted in the handle and arranged to direct light toward a distal end of the pick tool, and further including a power source within the handle operable to selectively activate the light.

5 Claims, 1 Drawing Sheet

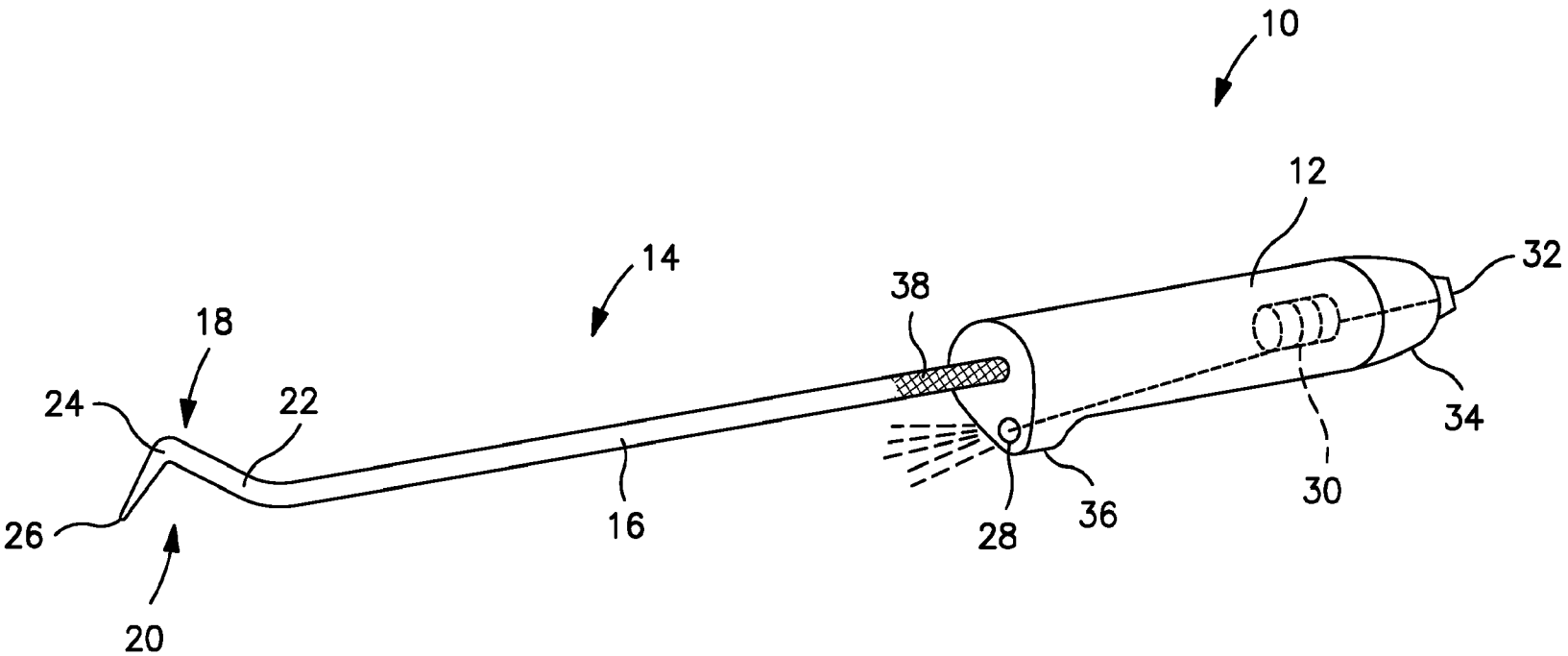
10
12
14
16
18
20
22
24
26
28
30
32
34
36
38

LIGHTED PICK TOOL

CROSS-REFERENCE TO RELATED APPLICATION

This application claims the benefit of provisional application Ser. No. 61/500,688, filed Jun. 24, 2011.

BACKGROUND OF THE INVENTION

The invention relates to hand tools, and more particularly to a pick tool for use in various applications.

Scribers, hooks and picks are various types of hand tools which can be used for numerous purposes such as releasing or installing headlight springs, removal of small fuses and stuck parts, separation of wires in awkward places, retrieval of lost nuts, bolts, washers and tools from tight areas, removing springs from oil burner relay boxes, making die layouts and the like. Such tools are used by various technicians, and the location of use can at times be an area which is dark and therefore difficult to see.

The need exists for an improvement to this situation. It is the goal of the present disclosure to provide such an improvement.

SUMMARY OF THE INVENTION

In accordance with the present invention, the foregoing problem has been solved. According to the invention, a pick tool is provided which has a handle and a light member mounted within the handle for directing light, preferably light from an LED source, toward the pick end of the tool.

Thus, in accordance with the present invention, a lighted pick tool is provided which comprises a handle, a pick tool extending from the handle, a light mounted within the handle for directing light toward a distal end of the pick tool and a power source within the handle and operative to activate the light when desired.

BRIEF DESCRIPTION OF THE DRAWINGS

A detailed description of preferred embodiments of the present invention follows, with reference to FIG. 1, which is a perspective view of a tool in accordance with the invention.

DETAILED DESCRIPTION

The invention relates to a lighted pick tool 10 as shown in FIG. 1. Pick tool 10 in accordance with the invention has a handle 12 and a pick 14 extending from handle 12. Pick 14 is preferably a substantially elongate shaft 16 with a bent pick 18 at a distal end 20 of shaft 16. Pick 18 can preferably be formed by a first bend 22 in the tool away from the general longitudinal axis of shaft 16, and a second bend 24 back toward the longitudinal axis of shaft 16. Pick 14 can preferably taper to a point 26 at distal end 20. As is known to persons skilled in the art, such a tool is useful for delicate work in tight or confined spaces.

In accordance with the invention, light 28 is positioned within handle 12, along with a power source 30 which is connected to light 28 through typical connection (schematically shown) which would be well known to a person skilled in the art, and a push button 32 for selectively activating the power source to power light 28. In order to access power source 30, which can be any typical and suitable battery for the intended use, handle 12 preferably has an end cap 34 which is threadedly or otherwise connected to handle 12 and which can be removed to access the compartment for power source 30, and to change a battery or other power source when needed. Push button 32 can suitably be mounted in end cap 34, if desired, or at any other desired location of handle 12. However, it is desired for simplicity of manufacture and ease of use to position push button 32 on end cap 34 as show in FIG. 1.

In use, pick tool 10 can be used as would normally be done by a technician having need of such a tool. When required, due to poor lighting at a difficult to reach location, push button 32 can be used to activate light 28 which directs light along the axis of shaft 16 and illuminates the area of work as desired in accordance with the invention.

Lights 28 can preferably be LED-type or alternatively can be other suitable lights, preferably sufficiently bright to fully illuminate an area 6 inches or more away from handle 12.

Light 28 can be mounted in a laterally extending portion of handle 12, and the laterally extending portion is shown at 36. Thus, while handle 12 can have a generally round circumference, laterally extending portion 36 can extend out of the generally round circumference of handle 12 as shown. This can help to direct the light as desired along the axis of shaft 16 but laterally spaced from shaft 16, and this lateral spacing helps to prevent obstruction of the light during use of the tool.

In a preferred embodiment, point 26 of tool 10, extends at an angle, relative to the axis of shaft 16, and is angled radially to align with laterally extending portion 36. In this way, when the light member is mounted in laterally extending portion 36, it will direct light at the article to be worked on with point 26. Thus, light will be directed along a path having a center which is spaced from point 26.

Handle 12 can be made of any injection molded plastic or other materials as desired. Pick 14 is typically a metallic tool suitable for potential stresses during the intended use.

Shaft 16 of pick 14 may have a knurled portion 38 as shown, typically for use in manipulating shaft 16 during assembly of tool 10, and the like.

While the present disclosure has been made with reference to an exemplary preferred embodiment, it will be understood by those skilled in the art that various changes may be made and equivalents may be substituted for the elements thereof without departing from the scope of the present disclosure. In addition, many modifications may be made to adapt a particular situation or material to the teachings of the disclosure, and the scope of this disclosure will include all embodiments falling therein.

What is claimed is:

1. A lighted pick tool, comprising:

a handle;

a pick tool extending from the handle; and a light mounted in the handle and arranged to direct light toward a distal end of the pick tool, and further including a power source within the handle operable to selectively activate the light, wherein the handle has a generally round circumference and a laterally extending portion extending beyond the circumference, wherein the light is mounted in the laterally extending portion and wherein the pick tool has a shaft and a point, wherein the point is angled relative to the shaft, and the point extends radially in alignment with the laterally extending portion.

2. The tool of claim 1, wherein the pick tool is a substantially elongate shaft having a pick defined at a distal end by a first bend in the shaft away from a longitudinal axis of the shaft, a second bend back toward the longitudinal axis of the shaft, and a tapering portion distal of the second bend and terminating in the point.

3. The tool of claim 2, wherein the light is arranged to direct light along a path having a center which is spaced from the point.

4. The tool of claim 3, wherein each of the first bend and the second bend is defined by a corner.

5. The tool of claim 4, wherein the elongate shaft extends co-planar with the longitudinal axis through the first bend in the shaft and the second bend, and terminates in a single end defining the point.

* * * * *